US010100499B2

(12) United States Patent
Hedley

(10) Patent No.: US 10,100,499 B2
(45) Date of Patent: Oct. 16, 2018

(54) RETAINING PIN INSTALLATION/REMOVAL TOOL AND METHOD

(71) Applicant: Justoy Pty Ltd, Mount Thorley, NSW (AU)

(72) Inventor: Robert Ian Hedley, Buttaba (AU)

(73) Assignee: Justoy Pty Ltd, Mount Thorley, NSW (AU)

( * ) Notice: Subject to any disclaimer, the term of this patent is extended or adjusted under 35 U.S.C. 154(b) by 115 days.

(21) Appl. No.: 15/126,241

(22) PCT Filed: Feb. 27, 2015

(86) PCT No.: PCT/AU2015/050080
§ 371 (c)(1),
(2) Date: Sep. 14, 2016

(87) PCT Pub. No.: WO2015/143498
PCT Pub. Date: Oct. 1, 2015

(65) Prior Publication Data

US 2017/0081829 A1 Mar. 23, 2017

(30) Foreign Application Priority Data

Mar. 25, 2014 (AU) ..... 2014901060

(51) Int. Cl.
*E02F 9/28* (2006.01)
*B25B 27/04* (2006.01)

(52) U.S. Cl.
CPC ..... *E02F 9/2891* (2013.01); *B25B 27/04* (2013.01); *E02F 9/2883* (2013.01)

(58) Field of Classification Search
CPC ..... E02F 9/2891; E02F 9/2883; B25B 27/04
See application file for complete search history.

(56) References Cited

U.S. PATENT DOCUMENTS

| | | | |
|---|---|---|---|
| 3,967,361 | A | 7/1976 | Merkel et al. |
| 6,453,657 | B1 | 9/2002 | Teravainen |
| 2011/0154799 | A1 | 6/2011 | Sevrette |

OTHER PUBLICATIONS

International Search Report corresponding to PCT/AU2015/050080 dated May 1, 2015.
International Preliminary Report on Patentability corresponding to PCT/AU2015/050080 dated Jul. 29, 2016.

*Primary Examiner* — John C Hong
(74) *Attorney, Agent, or Firm* — Kilpatrick Townsend & Stockton

(57) ABSTRACT

A tool for installation or removal of a retaining pin to or from aligned bores in first and second components. The tool includes a drive rod adapted to be positioned adjacent a first end of the aligned bores.

An actuator is operable to move the drive rod, to thereby push the retaining pin into or from the aligned bores.

11 Claims, 5 Drawing Sheets

RETAINING PIN INSTALLATION/REMOVAL TOOL AND METHOD

BACKGROUND OF THE INVENTION

The present invention relates to a tool for installation and/or removal of a retaining pin to or from aligned bores in components. In particular, the present invention relates to a tool for use to install or remove a retaining pin, which is typically used for attachment of a wear tooth to a tooth adaptor of a mining, earthmoving or like vehicle or machine. The present invention also relates to a method of installing or removing such a retaining pin.

DESCRIPTION OF THE PRIOR ART

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

Wear teeth are typically attached to mining or earthmoving equipment such that they can be readily removed and replaced as they wear out. It is well known to attach a wear tooth to a tooth adaptor by means of a retaining pin being positioned in aligned bores of the wear tooth and tooth adaptor.

Whilst the use of such a retaining pin has significant time and cost advantages over previous methods of attaching a wear tooth to a tooth adaptor by welding or other forms of securement, such a retaining pin is typically removed using an extractor pin which is then forcibly struck with a sledge hammer or the like. This operation requires considerable physical effort and is also prone to user injury.

SUMMARY OF THE INVENTION

The present invention seeks to overcome at least some of the disadvantages of the prior art, by providing a tool for installation or removal of a retaining pin which requires less physical effort or exertion by a user, and is typically safer, in use.

The present invention also seeks to provide a tool and a method for installing or removing a retaining pin to or from aligned bores in first and second components in which the process is effectively performed without substantive physical effort of a user, but rather, by utilising an actuator such as, but not limited to, a hydraulic cylinder, a pneumatic cylinder or an electric motor.

In one broad form, the present invention provides a tool for installation or removal of a retaining pin to or from aligned bores in first and second components, said tool including:

a drive rod, adapted to be positioned adjacent a first end of said aligned bores; and, an actuator, operable to move said drive rod, to thereby push said retaining pin into or from said aligned bores.

Preferably, the tool further includes a securement mechanism, adapted to releasably secure said tool to at least one of said first and second components.

Also preferably, the actuator includes at least one of a hydraulic cylinder; a pneumatic cylinder; and, an electric motor.

Preferably, said securement mechanism includes a frame, adapted to substantially surround said first and second components.

Also preferably, said frame includes:

a pair of heads, each head adapted to substantially align with said bores of said components; and a pair of adjustable brace members, for positional adjustment of said heads relative to each other.

Preferably, the tool further includes a pair of adjustable arms extending outwardly from each of said heads, for positional adjustment of said brace members relative to each other.

Preferably, each head includes a pivoting neck portion, for angular adjustment thereof.

Also preferably, said drive rod and said actuator are substantially housed in a first of said heads.

Preferably, the tool further includes a pin receptacle is housed within a second of said heads.

Preferably, said first and second components include a wear tooth and tooth adaptor of a mining, earthmoving or like vehicle or machine.

In a further broad form, the present invention provides a method of installing or removing a retaining pin to or from aligned bores of first and second components, including the steps of:

operating said tool, such that an actuator moves a drive rod to thereby push said retaining pin into or from said aligned bores.

Preferably, the method includes the preliminary step of securing said tool to at least one of said components.

Preferably, said actuator includes at least one of:

a hydraulic cylinder;

a pneumatic cylinder; and, an electric motor.

Preferably, said first and second components include a wear tooth and tooth adaptor of a mining, earthmoving or like vehicle or machine.

BRIEF DESCRIPTION OF THE DRAWINGS

The present invention will become more fully understood from the following detailed description of preferred but non-limiting embodiments of the present invention, described in connection with the accompanying drawings, in which.

DETAILED DESCRIPTION OF PREFERRED EMBODIMENTS

Throughout the drawings, like numerals will be used to identify similar features, except where expressly otherwise indicated.

Figure 1:
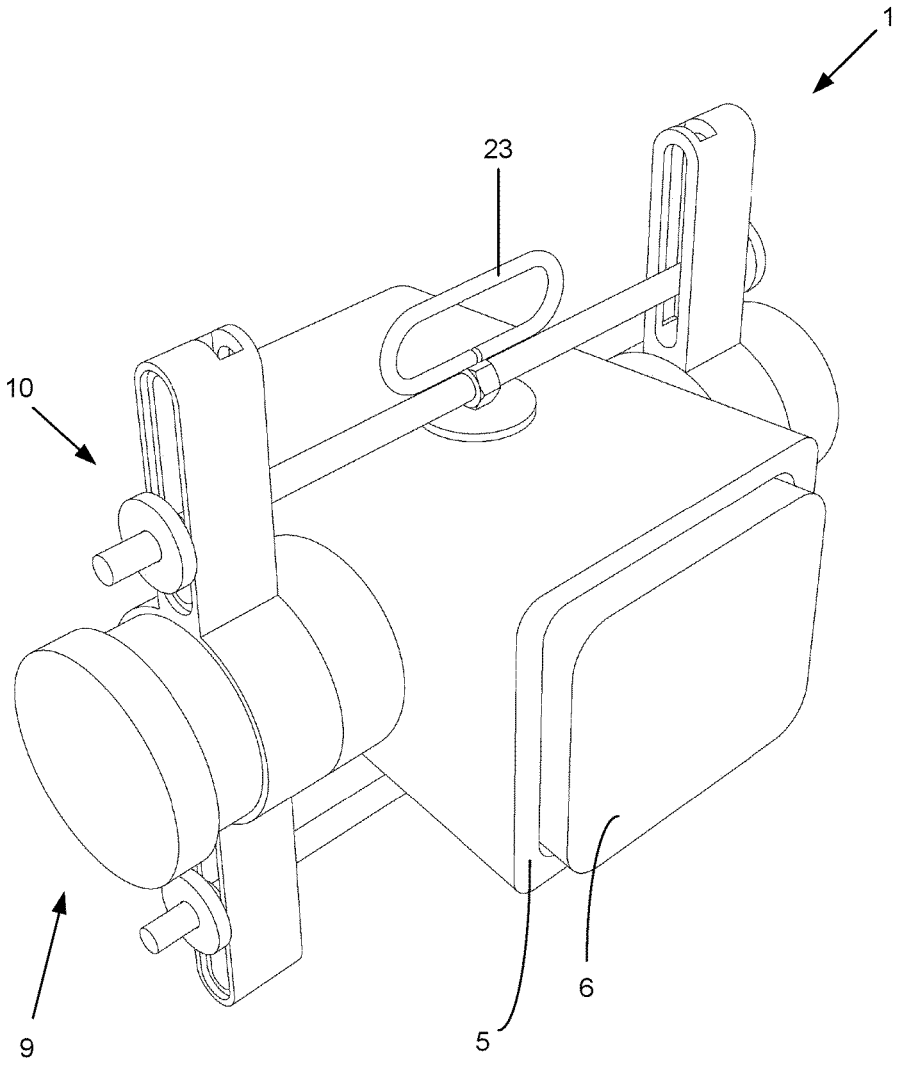
FIG. 1 illustrates a perspective view of a tool in accordance with the present invention, shown attached to the first and second components.
Figure 2:
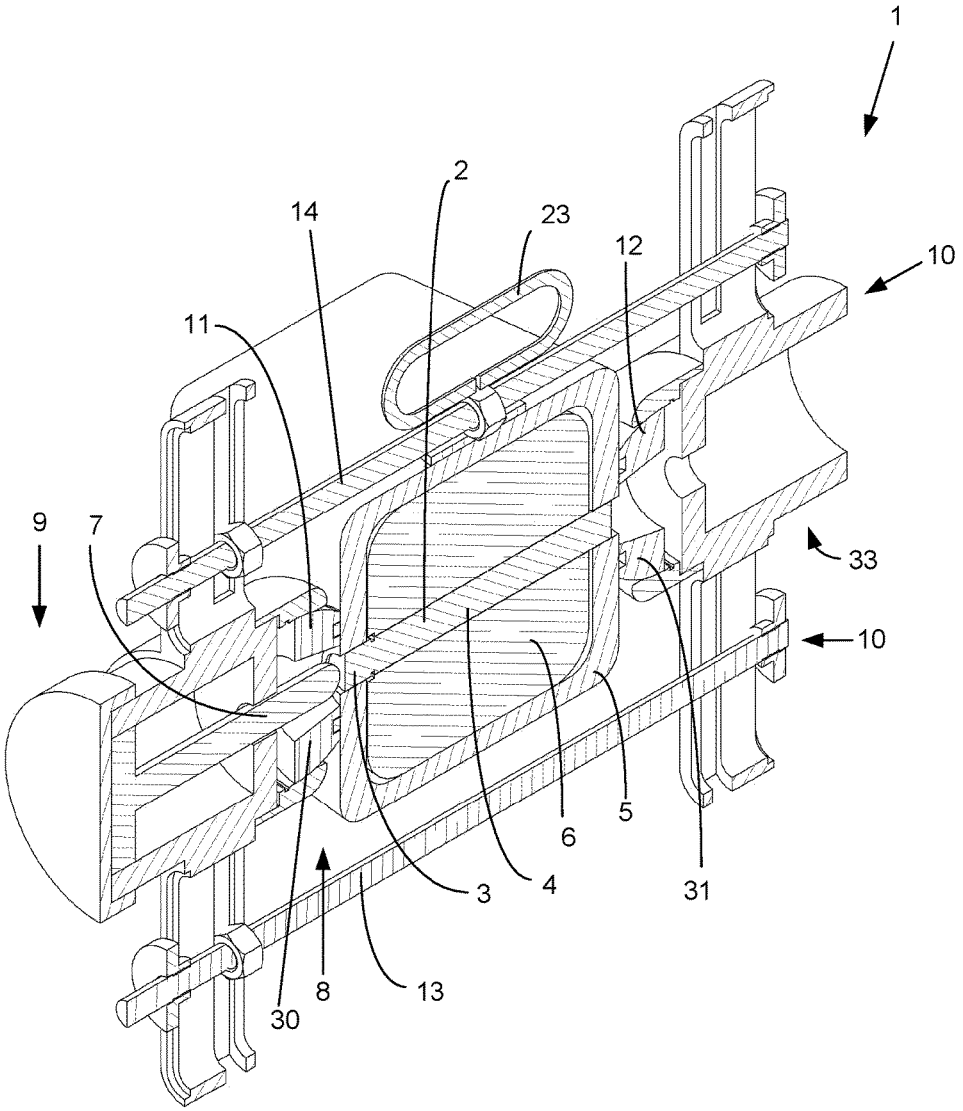
FIG. 2 illustrates a partly cut away view of the tool and components shown in FIG. 1.
Figure 3:
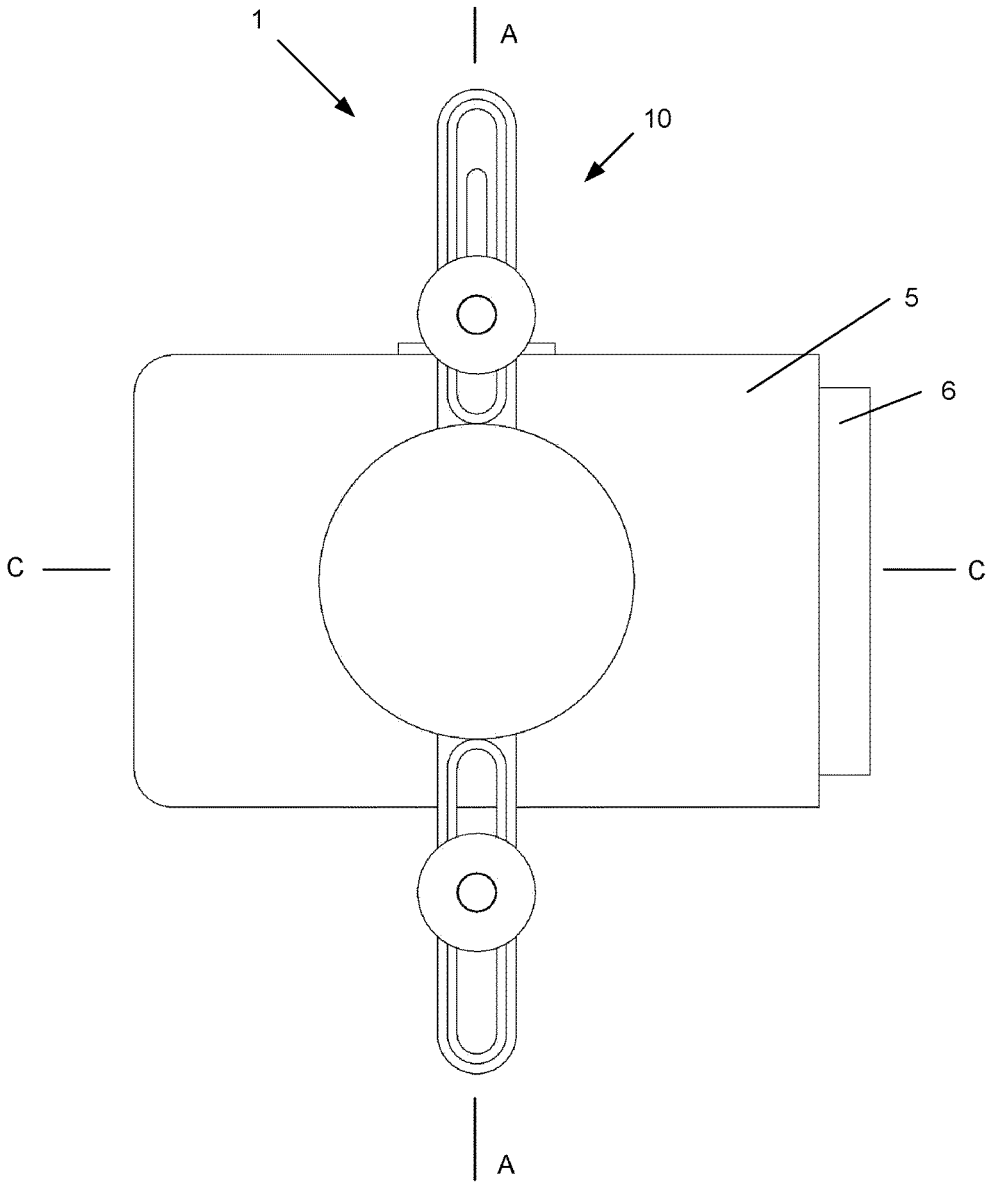
FIG. 3 illustrates an end view of the tool shown in FIG. 1.
Figure 4:
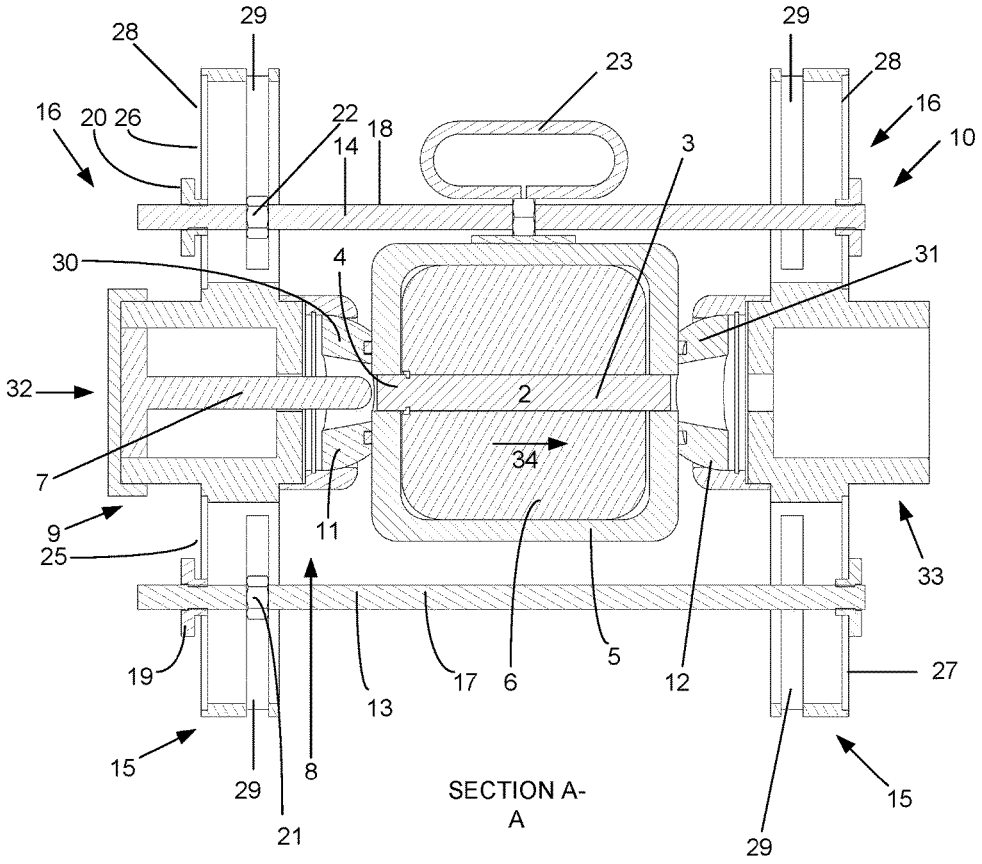
FIG. 4 illustrates a sectional view through Section A-A shown in FIG. 3; and, FIG. 5 illustrates a sectional view through Section C-C shown in FIG. 3.
Figure 5:
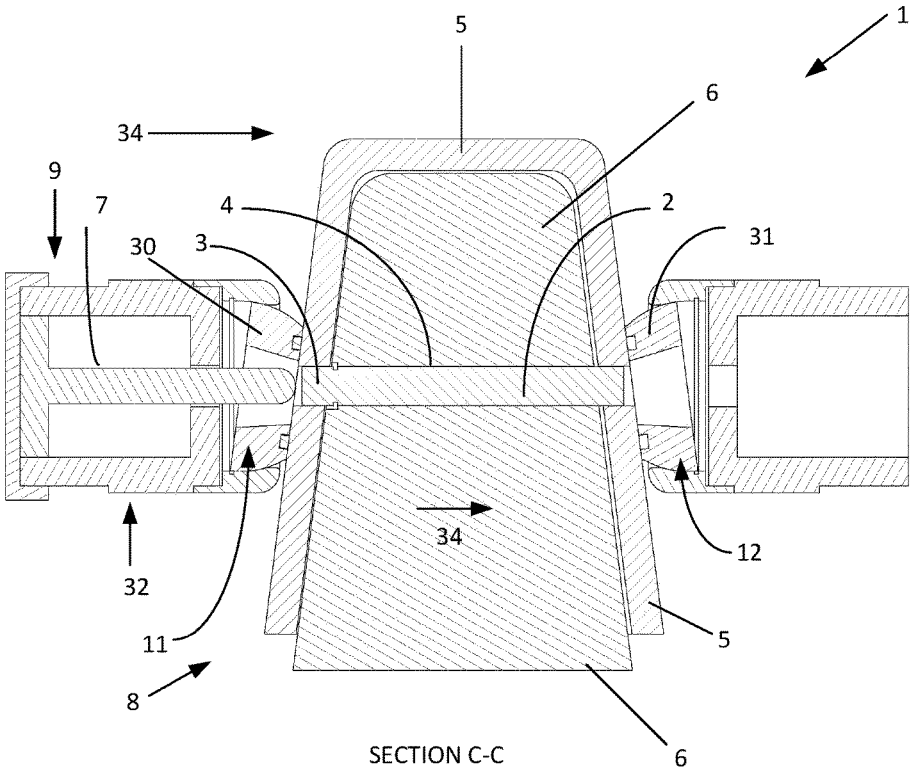

As shown in the drawings, the tool, generally designated by the numeral 1, is typically used for installing or removing a retaining pin 2 (as shown in FIGS. 2, 4 and 5) to or from aligned bores 3 and 4 provided in a wear tooth 5 and tooth adaptor 6, respectively. The tool 1 includes a drive rod 7, which is adapted to be positioned adjacent a first end 8 of the aligned bores 3 and 4, and, an actuator 9, operable to move the drive rod 7, to thereby push the retaining pin 2 into or from the aligned bores 3 and 4.

The tool 1 further includes a securement mechanism, embodied in the form of a frame 10, which is adapted to releasably secure or attach the tool 1 to at least one of the first and second components 5 and 6. The securement mechanism or frame 10 will be described in further detail hereinafter.

The tool 1 has advantages over the prior art in that it includes an automated actuator 9. The actuator preferably includes any one or more of a hydraulic cylinder, a pneumatic cylinder, an electric motor, or some other similar electromechanical or other actuator.

The securement mechanism 10, as previously mentioned, includes a frame, which is adapted to substantially surround the first and second components 5 and 6. The frame includes a pair of heads 11 and 12 each adapted to be substantially aligned with the bores 3 and 4 of the components 5 and 6. The frame further includes a pair of adjustable brace members 13 and 14 which include adjustment mechanisms 15 and 16 for positional adjustment of the heads 11 and 12 relative to each other. The adjustment mechanisms 15 and 16 may be embodied in the form of threaded rods 17 and 18 and cooperating nuts 19, 20, 21 and 22 which may be adjusted along rods 17 and 18 and then tightened to thereby effectively secure the heads 11 and 12 relative to each other.

One of the threaded rods may incorporate a handle 23, for user convenience in carrying and/or positioning the tool. The tool 1 may further include a pair of adjustable arms 25 and 26 extending outwardly from the first of the head 11, and a further pair of adjustable arms 27 and 28 extending from the second head 12. These adjustable arms allow for positional adjustment of the brace members 13 and 14 relative to each other and, as shown, may be embodied in the form of a slide channel which is adapted to cooperatively engage the nuts 21 and 22. Other forms of adjustment mechanisms to permit adjustment of the brace members 13 and 14, and, the adjustable arms 25, 26, 27 and 28 will become apparent and should be considered to be incorporated within the scope of the invention.

Each head 11 and 12 may further include a pivoting neck portion 30 and 31, for angular adjustment of the heads 11 and 12 such that the tool 1 may be securely engaged with at least one of the components 5, particularly when the contact surfaces of the component 5 are not perpendicular to the heads 11 and 12, but rather, are provided at a transverse angular disposition relative thereto. Various alternative forms of pivotal mechanisms will become apparent and should also be considered to be within the scope of the invention.

As shown in the drawings, the drive rod 7 and actuator 9 are provided in a housing 32 in a first of the heads 11, and a pin receptacle 33 is housed within a second of the heads 12.

As will be understood, the device of the present invention is particularly useful for installing and/or removing a retaining pin either onto or from a wear tooth and tooth adaptor of mining, earthmoving or like vehicle or machine.

In use, the device may typically be operated such that the actuator 9 moves the drive rod 7 to thereby push the retaining pin 2 into or from the aligned bores. The device may of course be utilised to just perform one of these operations of either installing or removing the retaining pin, or both.

As will be understood, in use, the tool is preferably initially secured to one of the components. In this case, as shown in the drawings, the tool 1 is installed and secured to the wear tooth 5 by firstly positioning the tool about the wear tooth, adjusting the adjustable brace members 13 and 14 as necessary, and adjusting the adjustable arms 25, 26, 27 and 28 as necessary, and then securing the various nuts and rods, such that the tool is preferably tightly abutted against the wear tooth with the pivoting neck portions angled appropriately from the heads such that the tool is firmly secured.

Once in position, the actuator 9 is operated and either draws the retaining pin into the aligned bores from the pin receptacle 33, or, if the pin 2 is required to be removed, the actuator is operated such that the drive rod is moved in the direction shown by arrow 34 such that the drive rod 7 abuts against the end of the retaining pin 2 to push the pin from the "installed" position shown in the drawings, to the "removed" position wherein the pin is pushed into the pin receptacle 33.

Whilst a particular embodiment of the tool has been shown in the drawings, it will be appreciated that numerous variations and modifications can be made. All such variations and modifications should be considered to be within the scope of the invention as broadly hereinbefore described and as hereinafter claimed.

The invention claimed is:

1. A tool for installation or removal of a retaining pin to or from aligned bores in first and second components, said tool including:

a securement mechanism adapted to releasably secure said tool to at least one of said first and second components, including a frame adapted to substantially surround said first and second components and a pair of heads, each head including a pivoting neck portion, for angular adjustment thereof, and being adapted to substantially align with said bores of said components;

a drive rod, adapted to be positioned adjacent a first end of said aligned bores; and, an actuator, operable to move said drive rod, to thereby push said retaining pin into or from said aligned bores.

2. The tool as claimed in claim 1, wherein the heads are adapted to abut at least one of said first and second components.

3. The tool as claimed in claim 1, wherein said actuator includes at least one of:

a hydraulic cylinder;

a pneumatic cylinder; and, an electric motor.

4. The tool as claimed in claim 1, wherein said frame includes a pair of adjustable brace members, for positional adjustment of said heads relative to each other.

5. The tool as claimed in claim 4, further including a pair of adjustable arms extending outwardly from each of said heads, for positional adjustment of said brace members relative to each other.

6. The tool as claimed in claim 1, wherein said drive rod and said actuator are substantially housed in a first of said heads.

7. The tool as claimed in claim 1, including a pin receptacle housed within a second of said heads.

8. The tool as claimed in claim 1, wherein said first and second components include a wear tooth and tooth adaptor of a mining or earthmoving vehicle or machine.

9. A method of installing or removing a retaining pin to or from aligned bores of first and second components, including the steps of:

securing said tool to at least one of said components by clamping said one of said components between two heads, wherein one or both of the heads is allowed to pivot; and operating said tool, such that an actuator moves a drive rod to thereby push said retaining pin into or from said aligned bores.

10. The method as claimed in claim 9, wherein said actuator includes at least one of:

a hydraulic cylinder;

a pneumatic cylinder; and, an electric motor.

11. The method as claimed in claim 9, wherein said first and second components include a wear tooth and tooth adaptor of a mining or earthmoving vehicle or machine.

* * * * *